US012637122B2

(12) United States Patent
Schwaiger et al.

(10) Patent No.: US 12,637,122 B2
(45) Date of Patent: May 26, 2026

(54) MONITORING DEVICE FOR A BUFFER STOP

(71) Applicant: AMX Automation Technologies GmbH, Linz (AT)

(72) Inventors: Meinhard Schwaiger, Linz (AT); Harald Werner Petschacher, Henndorf (AT)

(73) Assignee: AMX Automation Technologies GmbH, Linz (AT)

( * ) Notice: Subject to any disclaimer, the term of this patent is extended or adjusted under 35 U.S.C. 154(b) by 891 days.

(21) Appl. No.: 17/880,089

(22) Filed: Aug. 3, 2022

(65) Prior Publication Data

US 2023/0043292 A1 Feb. 9, 2023

(30) Foreign Application Priority Data

Aug. 4, 2021 (EP) ..... 21189674

(51) Int. Cl.
*B61L 5/10* (2006.01)
*B61K 7/18* (2006.01)

(52) U.S. Cl.
CPC . *B61L 5/10* (2013.01); *B61K 7/18* (2013.01)

(58) Field of Classification Search
CPC ... B61K 7/00; B61K 7/02; B61K 7/16; B61K 7/18; B61L 5/10
See application file for complete search history.

(56) References Cited

FOREIGN PATENT DOCUMENTS

| | | | | |
|---|---|---|---|---|
| DE | 3814342 A1 | 11/1988 | | |
| DE | 202010000526 U1 * | 10/2011 | ..... | B61K 7/18 |
| DE | 102010025037 A1 | 12/2011 | | |
| DE | 102018111093 A1 | 11/2019 | | |
| EP | 2314495 A1 | 4/2011 | | |
| WO | WO-2017116466 A1 * | 7/2017 | ..... | B63B 21/02 |

* cited by examiner

*Primary Examiner* — Robert J McCarry, Jr.
(74) *Attorney, Agent, or Firm* — Dykema Gossett PLLC

(57) ABSTRACT

The invention relates to a monitoring device (1) for a buffer stop (2) on a track system (3), having at least one acceleration sensor (100*a*, 100*b*) and a vibration measuring device (10). Improved monitoring can be achieved in that the vibration measuring device (10) is designed to calculate a displacement path of the buffer stop (2) from the signals detected by the acceleration sensor (100*a*, 100*b*).

17 Claims, 4 Drawing Sheets

MONITORING DEVICE FOR A BUFFER STOP

CROSS-REFERENCE TO RELATED APPLICATION

This application claims the benefit of priority to European application No. 21189674.1, filed 4 Aug. 2021.

BACKGROUND

The invention relates to a monitoring device for a buffer stop on a track system according to the preamble of patent claim 1.

Buffer stops for rail vehicles in the sense of the invention are brake buffer stops or stop devices which are connected non-positively to the track system and can additionally be designed with a linearly displaceable buffer system whose resistance force has a linear or non-linear, usually progressive, spring characteristic and can dissipate the absorbed kinetic energy by friction.

Rail vehicles in the sense of the invention are track-bound traction vehicles and/or wagons.

Buffer stops on track systems are used to stop rail vehicles in the stopping area of track ends if they cannot be brought to a halt in time by braking. In principle, rail vehicles must be braked and brought to a halt in good time so that they come to a halt before a buffer stop and do not collide with it. However, if the rail vehicle collides with the buffer stop as a result of excessive entry speed, delayed braking maneuver or insufficient braking effect, the excess kinetic energy of the rail vehicle is transferred to the buffer stop, with the consequences depending on the amount of kinetic energy resulting from the current speed and the total moving mass of the rail vehicle. Rail vehicles are usually designed with a buffer system that can absorb elastic deformation with a mostly progressive spring characteristic and additionally convert and dissipate part of the kinetic energy into frictional energy. If the kinetic energy of the rail vehicle colliding with the buffer stop is less than that energy which can be absorbed elastically/plastically by the buffer stop and the thrust force acting on the buffer stop in the process is less than the adhesive force of the buffer stop on the rail, the rail vehicle can be stopped safely by the buffer stop; such a collision is referred to as a moderate collision in the sense of the invention. However, if the kinetic energy of the rail vehicle colliding with the buffer stop is higher than the energy that can just be elastically/plastically absorbed by the buffer stop and/or the thrust force acting on the buffer stop is greater than the adhesive force of the buffer stop on the rail, the rail vehicle causes the buffer stop to move relative to the rail; such a collision is referred to as a violent/massive collision in the sense of the invention. If such collisions remain unnoticed, the protective effect of the buffer stop is drastically reduced for subsequent events, so that serious accidents could be the result, and clarification of causation is subsequently no longer possible due to the high volume of traffic and because suitable detection and information systems are lacking. Each violent/massive collision also causes material damage, because buffer stops have to be checked, readjusted and individual components or entire buffer stops replaced after such a collision.

DE 10 2018 111 093 A1 discloses a track path limitation system for rail vehicles, in which the barrier device (buffer stop) is moved longitudinally displaceably along the braking zone by means of a linear motor, and a braking force can be generated by means of the linear motor, wherein the entry speed of the rail vehicle is measured and evaluated to trigger the braking force. Disadvantages are the enormous power supply required to operate the system, the lack of overload protection that would prevent damage to the expensive system in the event of an overload, and the fact that existing systems cannot be retrofitted, but expensive new systems have to be installed.

DE 38 14 342 A1 discloses a device for braking a moving body that is unguided in the direction of motion, in which the braking device has a catch element that is synchronized with the approaching unguided body and dissipates the kinetic energy of the unguided body, thereby braking the unguided body. The disadvantages are that the available deceleration distance is limited and blocks at the end, so that the kinetic energy of the moving body that has not yet been dissipated causes damage to the deceleration device, and that retrofitting in existing systems is not possible, but expensive new systems would have to be installed.

DE 20 2010 000 526 U1 discloses a track system with buffer stop and several embodiment variants of sensor systems for detecting the position of the buffer stop relative to another (stationary) object by means of markings on the sleepers, by means of a rotary encoder and measuring wheel, by means of radio locating systems with anchor nodes, by means of laser or radar distance measuring systems, by means of a cable tension meter or an embodiment variant of the buffer stop with an acceleration sensor for recording the impact and the number of impact events, which may contain an electromechanical transducer for converting impact energy into electrical energy, and a communication device to a control station, which may be stationary or provided in the rail vehicle.

In this context, the acceleration sensor is used to determine the strength of an impact event, heuristically assuming that a displacement of the buffer stop is to be expected above a certain minimum strength (maximum value of acceleration). The extent of the displacement can be determined by separately provided distance measuring systems, which is necessary because it is not possible to determine the displacement from the strength of the acceleration alone.

A disadvantage is the elaborately designed extensive sensor and communication system and the costly infrastructure.

It is the object of the invention to avoid these disadvantages and to specify a monitoring device of a buffer stop on a track system with which a collision event can be detected in a simple manner and evaluated in such a way that the displacement of the buffer stop caused by the collision event can be determined. This should make it possible to assign the respective displacement to the underlying collision.

SUMMARY OF THE INVENTION

According to the invention, these objects are solved by a monitoring device according to claim 1. It is thus provided that the vibration measuring device is designed to calculate a displacement path of the buffer stop from the signals detected by the acceleration sensor.

An essential aspect of the present invention is the realization that an acceleration sensor can not only be used to make qualitative statements about a collision event, but also to determine the displacement path relatively accurately without the need for separate distance measurement systems.

The monitoring device according to the invention can be arranged on the buffer stop as a whole, but a distributed arrangement with an acceleration sensor arranged on the buffer stop and an evaluation unit arranged in a control station that communicates with the acceleration sensor is also possible.

It is particularly preferred if the vibration measuring device is designed to integrate the signal of the acceleration sensor twice. High accuracy can be achieved by starting the integration when the signal of the acceleration sensor exceeds a first threshold value and ending it when the signal of the acceleration sensor falls below a second threshold value for a predetermined period of time. Thus, the fact that it is safe to assume that the buffer stop is not moving in the absence of significant acceleration is exploited. An undesirable drift can thus be avoided as far as possible. The threshold values are selected in such a way that minor accelerations triggered by passing trains, for example, are not taken into account, with typical threshold values being accelerations in the range from 0.1 $m/s^2$ to 1 $m/s^2$. The predetermined time period in which the acceleration must fall below the second threshold value in order to end the integration can typically be set at a few tenths of a second, since the vibrations that occur are strongly damped and the decay time is short. As a result of these measures, the inaccuracy to be expected per se due to the double integration can be kept relatively small. It is particularly advantageous if the vibration measurement is performed in multiple axes, preferably in the direction of travel, 90° transverse to the direction of travel and parallel to the track system, and 90° to the direction of travel and vertical to the track system. This allows the collision event to be analyzed even more precisely. In a collision event, a transverse acceleration of the buffer stop indicates an asymmetrical application of force by the colliding rail vehicle with the buffer stop, in which the collision forces are dissipated unevenly into the anchoring of the buffer stop and act disproportionately on one side. The acceleration acting vertically to the track system generates forces that act in the same direction as the bolt prestressing forces, thereby influencing and reducing the friction between the buffer stop and the track system.

A further increase in measuring accuracy can be achieved by providing a distance measuring device for determining the distance of an arriving rail vehicle to the buffer stop and for determining the speed profile of the rail vehicle. It has been found, in fact, that certain errors in determining the displacement path depend on whether a rail vehicle with a relatively low mass hits the buffer stop at a higher speed or a rail vehicle with a relatively high mass hits the buffer stop at a lower speed, even if the energy introduced should be the same in both events. Now, if the speed of the rail vehicle immediately before hitting the buffer stop is known, error correction can be performed to arrive at a more accurate result. In addition to this, it is possible to use this speed signal in conjunction with the distance to trigger a warning signal to prevent or at least mitigate the collision event.

It is also advantageous if a video camera is provided for recording collision events, preferably coupled to the acceleration sensor. This makes it possible to also obtain visual evidence of the causation of a collision event. In the simplest case, the camera is coupled to the acceleration sensor, for example in the form that the camera permanently performs image recordings and deletes and overwrites them again after a predetermined time has elapsed, for example after one hour. However, if the acceleration sensor detects a collision event, then the image recording is permanently stored in a relevant time period, for example 10 minutes before to 10 minutes after the collision event. If a distance measuring device is present, then it is also possible to start recording only when a rail vehicle approaches and to stop recording after the collision event.

A particularly preferred aspect of the present invention is that a recording device can be provided for storing the recorded data. In this way, responsibility can be unambiguously assigned to the party causing an impermissible displacement of the buffer stop.

It is possible for the data recorded at the buffer stop to be transmitted to a control station via a data line. It is particularly preferred if a transmission device is provided for transmitting the recorded data to a control station. This avoids the expense of laying corresponding data cables. The data recorded at the buffer stop can be the raw data of the acceleration sensor, but it is also possible to evaluate the data directly at the buffer stop and transmit the results thereof to the control station.

The present invention also relates to a buffer stop comprising a frame, at least one buffer attached to the frame, and an anchoring device.

According to the invention, it is provided that a monitoring device of the type described above is mounted on the buffer stop. It is particularly preferred if the monitoring device is arranged on the frame of the buffer stop. It has been found that the closer the monitoring device is arranged to the anchorage of the buffer stop, the more favorable it is. Vibrations caused by the deformation of the buffer and the frame of the buffer stop are not or only to a small extent detected by the acceleration sensor. In this way, the accuracy of the calculation can be increased.

A particularly favored embodiment variant of the present invention provides for a further acceleration sensor. This is arranged at a different point on the buffer stop, for example on the buffer. With this measure, too, it is possible to increase the calculation accuracy by making corrections on the basis of the further measurement signal.

The present invention also relates to a method for monitoring a buffer stop, in which the signal from an acceleration sensor is detected and evaluated.

In this method, a monitoring device of the type described above is attached to the buffer stop and operated.

BRIEF DESCRIPTION OF THE DRAWINGS

The invention is explained in more detail below with reference to the figures, wherein.

DETAILED DESCRIPTION

Figure 1:
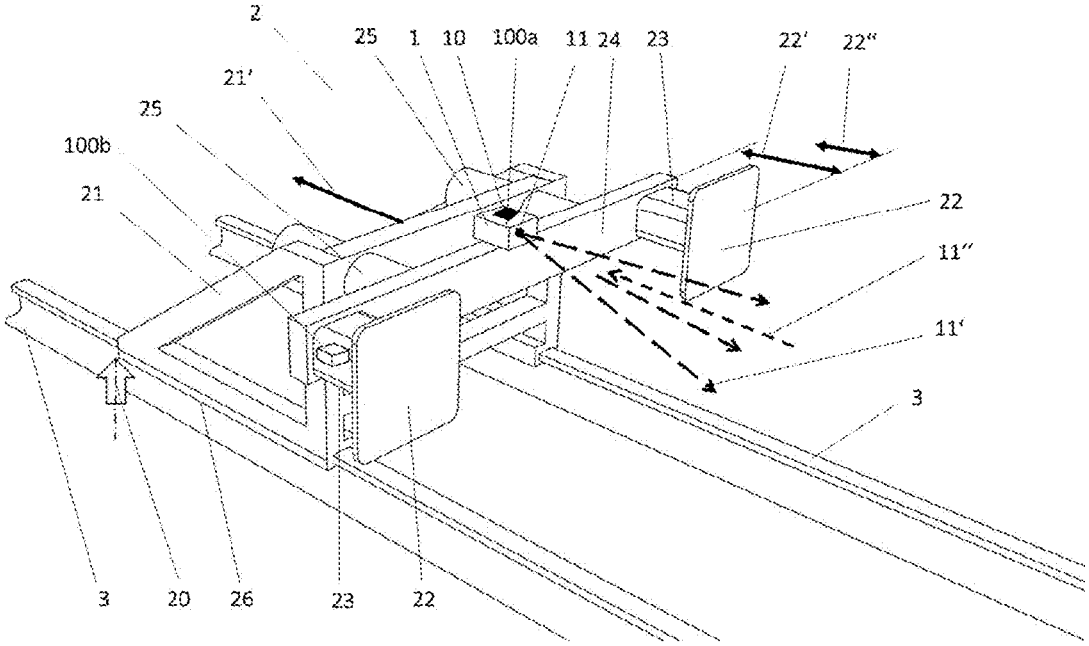
FIG. 1 shows a monitoring system according to the invention having a buffer stop in perspective oblique view.
Figure 2:
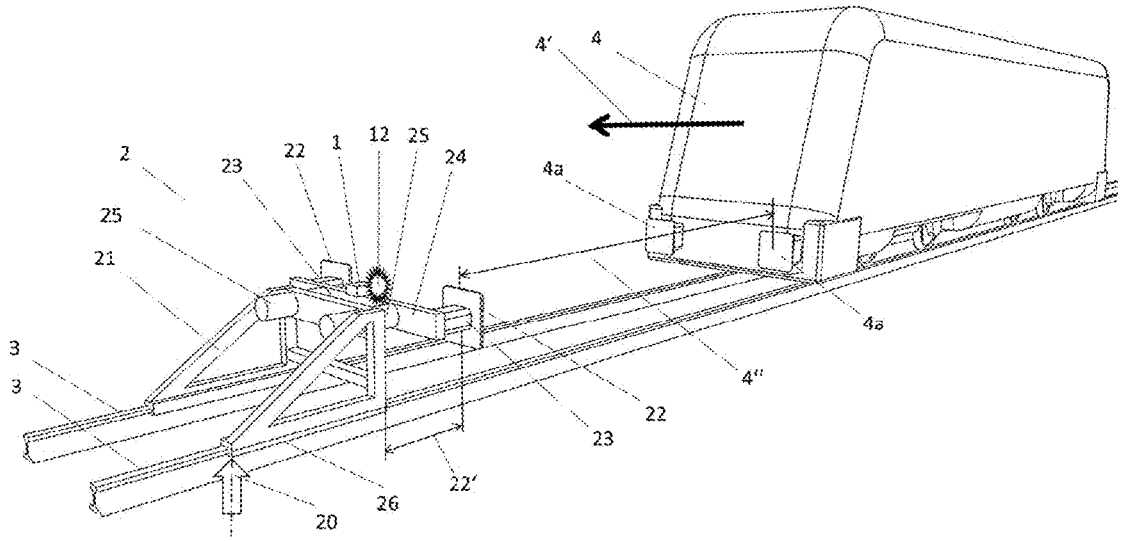
FIG. 2 shows an oblique perspective view of a monitoring system according to the invention having a buffer stop with a rail vehicle approaching the buffer stop.

FIG. 1 and FIG. 2 show a monitoring system 1 according to the invention, consisting of a vibration measuring device 10, for detecting a collision and a vibration pattern, a distance measuring device 11, preferably designed as a Time of Flight (ToF) camera, having a transceiver unit for transmitting 11' and for receiving reflected 11" pulsed light beams in the infrared range or laser beams, for determining the distance 4" of a rail vehicle 4, which can be designed with one or more buffers 4*a* and approaches the buffer stop 2 at the speed v in the direction of movement 4' of the rail vehicle, and an optical/acoustic warning device 12, as well as the monitored buffer stop 2, consisting of a frame 21, which is connected non-positively by means of a clamping device 26 to the track system/rail 3 at a defined position 20, which furthermore has one or more impact plates 22 which are connected to the frame 21 directly or to one or more buffers 23 which are mounted in a holder with spring damping elements, wherein further holding devices 24 and further spring damping elements 25 can also be present, and wherein the impact plate 22 has a distance 22' relative to the frame 21 and can be elastically/plastically deformed under load by the amount 22", wherein the frame 21 is displaced in the direction 21' in the event of a violent/massive collision in which the force transmitted to the buffer stop 2 by the impulse energy of the rail vehicle 4 is higher than the maximum adhesive force possible by the clamping device 26.

A first acceleration sensor 100*a* is arranged in the vibration measuring device 10, which measures the longitudinal acceleration of the monitoring device 1 and thus of the buffer stop 2.

Figure 3:
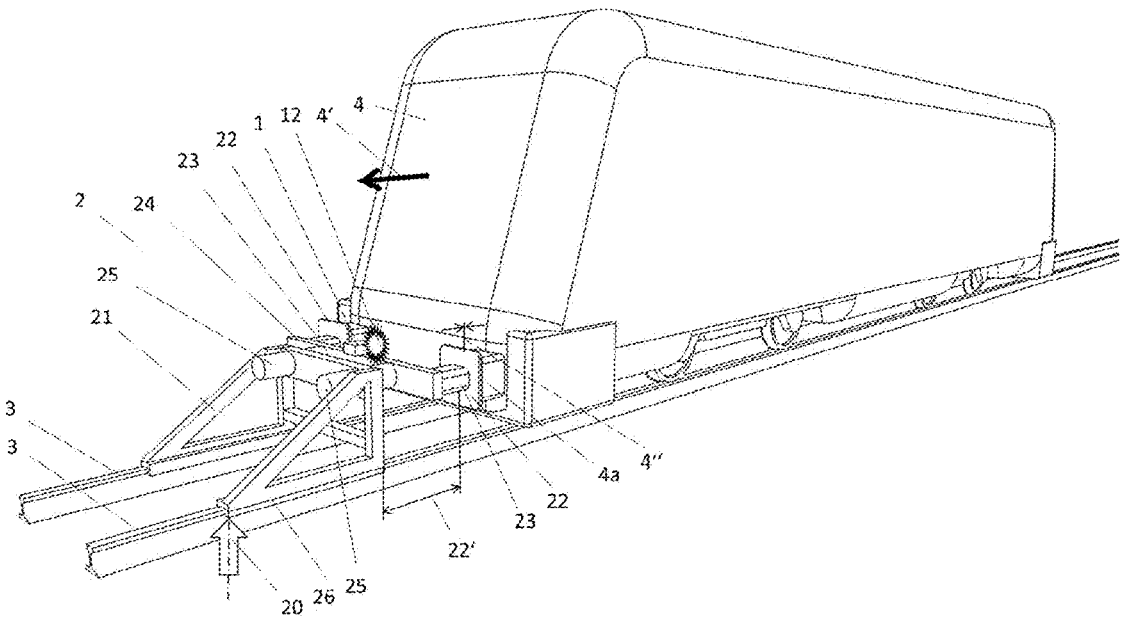
FIG. 3 shows an oblique perspective view of a monitoring system according to the invention having a buffer stop with a rail vehicle momentarily colliding with the buffer stop.

FIG. 3 shows the rail vehicle 4, which has approached the buffer stop, in a state in which the impact plate 22 of the buffer stop 2 and the buffer of the rail vehicle 4 are just touching.

Figure 4:
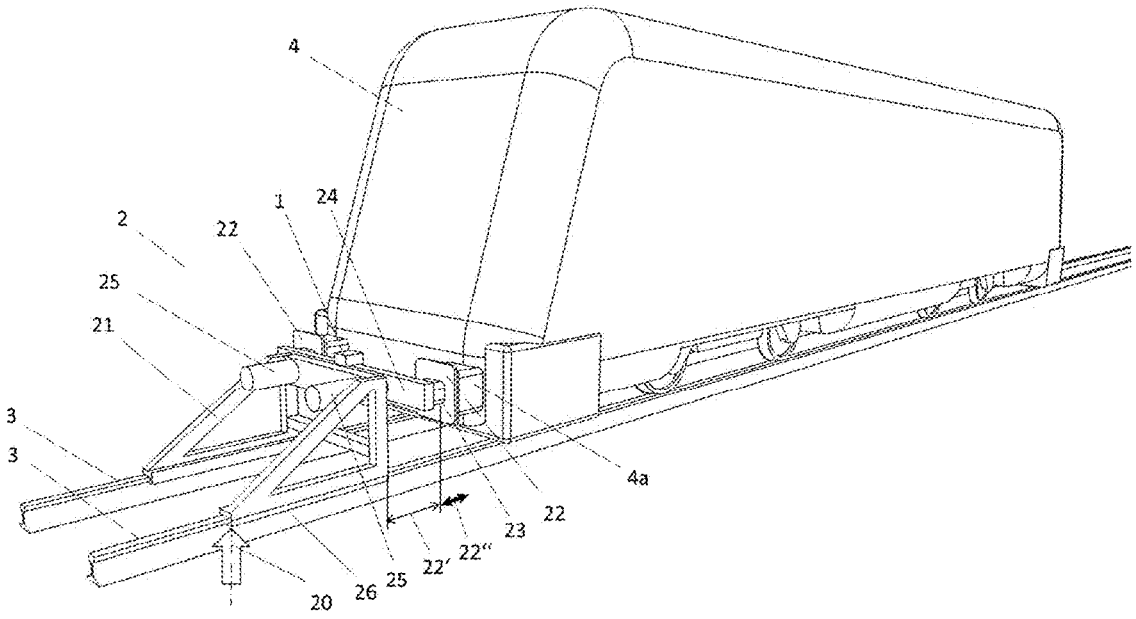
FIG. 4 shows an oblique perspective view of a monitoring system according to the invention having a buffer stop with a rail vehicle moderately collided with the buffer stop.

FIG. 4 shows the buffer stop 2, after a moderate collision of the rail vehicle 4 with the buffer stop 2, in a state in which the impact plate 22 of the buffer stop 2 and the buffers 23 have been elastically/plastically deformed relative to the frame 21 to the distance 22' by the amount 22" and the adhesive force of the clamping device 26 is higher than the force transmitted to the buffer stop 2 by the impulse energy of the rail vehicle 4.

Figure 5:
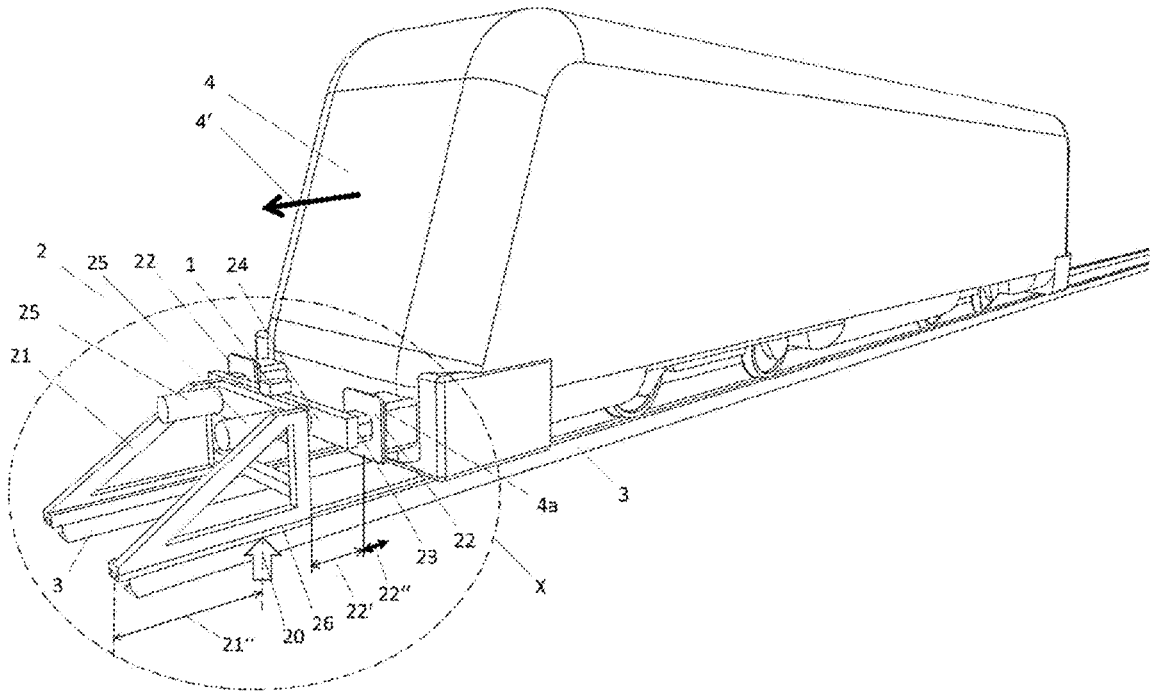
FIG. 5 shows an oblique perspective view of monitoring system according to the invention with a buffer stop, displaced on the track system as a result of a violent/massive collision of the rail vehicle with the buffer stop.

FIG. 5 shows the buffer stop 2, after a violent/massive collision of the rail vehicle 4 with the buffer stop 2, in a state in which the impact plate 22 and the buffer 23 have been elastically/plastically deformed relative to the frame 21 to the distance 22' by the amount 22" and the adhesive force of the clamping device 26 was not sufficient to be able to withstand the impulse force transmitted to the buffer 2 by the impulse energy of the rail vehicle 4, so that the buffer 2 has been displaced by the amount 21" relative to the defined original position 20.

Figure 6:
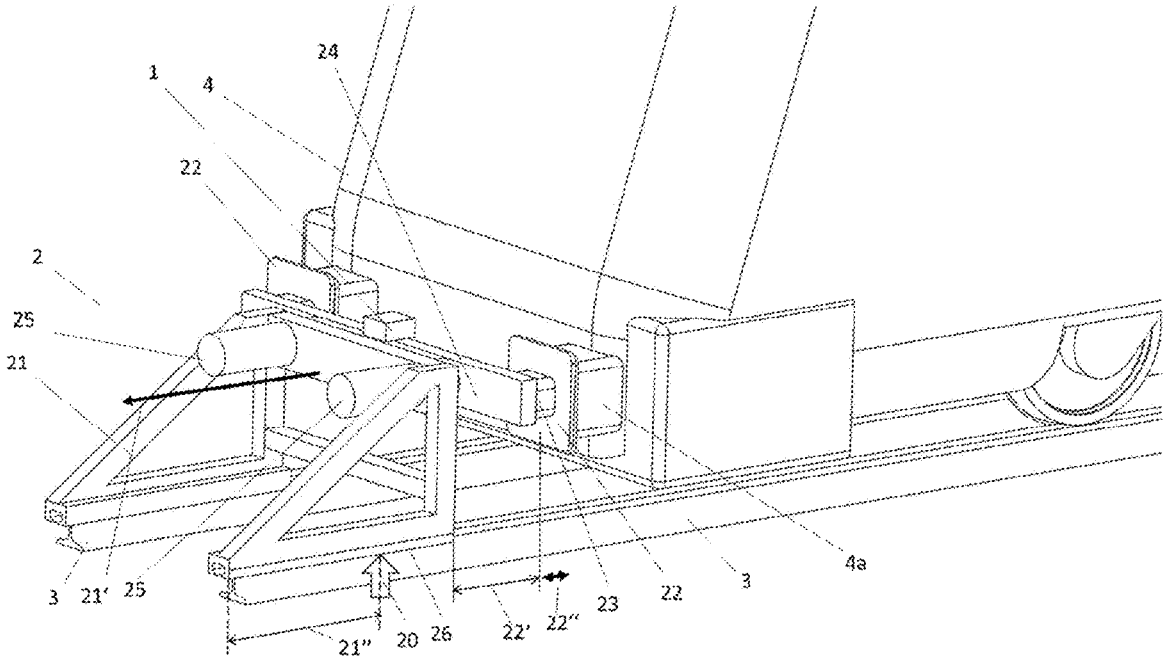
FIG. 6 shows a detailed view X of the displaced buffer stop of FIG. 5.

FIG. 6 shows detail X of FIG. 5.

Figure 7:
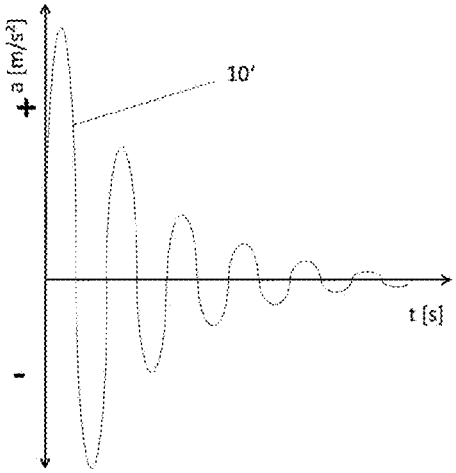
FIG. 7 shows a vibration curve (acceleration)—damped vibration with moderate collision of the rail vehicle with the buffer stop.

FIG. 7 shows a typical (idealized) vibration curve 10' (acceleration a [m/s$^2$]), of the buffer stop 2 in a moderate collision as a free damped vibration (response spectrum).

Figure 8:
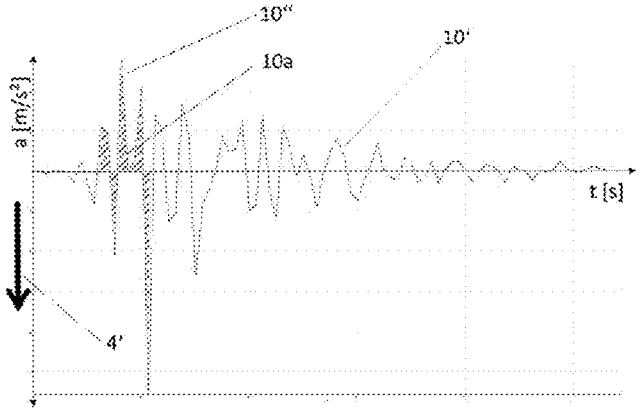
FIG. 8 shows a vibration curve (acceleration at the measuring point of the buffer stop) due to violent/massive collision of the rail vehicle with the buffer stop.

FIG. 8 shows an idealized vibration curve 10" (acceleration a [m/s$^2$]) at the measuring point of the buffer stop 2 in the case of a violent/massive collision, in which the damped vibration is superimposed by a linear displacement, and the typical (idealized) vibration curve 10' (acceleration) of a free damped vibration, which is then formed after the buffer stop 2 has come to a standstill. The discrete time integral of the acceleration curve 10", which is indicated in sections by 10*a*, results in the computationally determined discrete velocity curve (v [m/s]) of the displacement of the buffer stop 2 according to FIG. 9.

Figure 9:
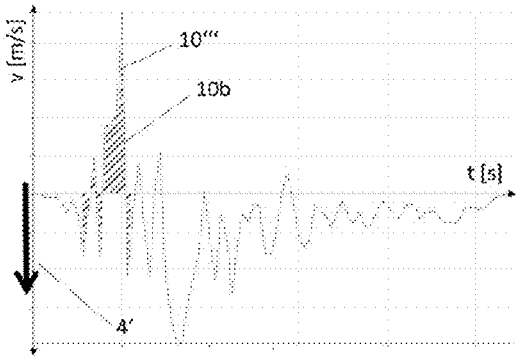
FIG. 9 shows a vibration curve (speed at the measuring point of the buffer stop) as a result of a violent/massive collision of the rail vehicle with the buffer stop.

FIG. 9 shows the calculated velocity curve (v [m/s]) 10''' of the displacement of the buffer stop at the measuring point of the buffer stop, with 10*b* the time integral of the acceleration signal 10*a* of FIG. 8 is shown, and the discrete time integral of the velocity curve (v [m/s]) results in the discrete displacement path (s [m]) 10*c* at the measuring point for the time interval according to 10*a* and 10*b*, respectively, wherein the curve of the fictitious displacement path 10*c* at the measuring point is superimposed by elastic springback effects.

Figure 10:
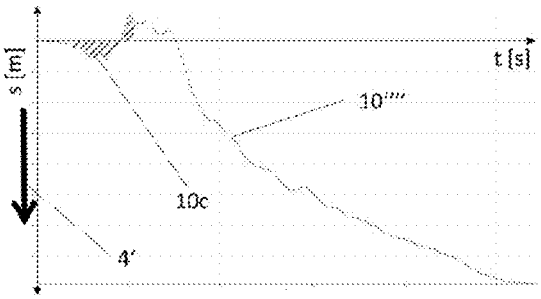
FIG. 10 shows a time curve of the displacement at the measuring point of the buffer stop as a result of a violent/massive collision of the rail vehicle with the buffer stop.

FIG. 10 shows the time curve of the displacement path (s [m]) 10'''' by summing up the discrete displacement paths. 10*c* represents a time interval in which a displacement in the direction of travel 4' of the train takes place, followed by an elastic springback of the buffer stop at the measuring point.

In a further embodiment variant, the monitoring device 1 according to the invention for buffer stops 2 on a track system 3 has a distance measuring device 11 for detecting the distance 4" between the buffer 4*a* of the rail vehicle 4 entering the track end area and the impact plate 22 of the buffer stop 2 or, in general, the distance 4" between the rail vehicle 4 and the buffer stop 2 and for detecting the current speed of the rail vehicle 4 entering the entry area of the track end system with a delay. The distance measurement is preferably carried out according to the Time of Flight (ToF) principle, in which a pulsed light beam 11' is emitted by the distance measuring device 11 and reflected by the detected object, the entering rail vehicle 4, and impinges on the sensor of the distance measuring device as a reflected light beam 11". The distance of the object from the distance measuring device is determined from the transit time of the light pulses, which is required between the emission of the light pulse and the impingement on the sensor of the distance measuring device. If the distance measuring device 10 is based on a sensor with a single pulsed light beam, the distance can only be measured to a single point of the incoming rail vehicle 4. When using a distance measuring device 11 based on a sensor having a plurality of measuring points in a matrix arrangement, the incoming rail vehicle 4 can be detected as a three-dimensional object from the perspective of the distance measuring device, and a bundle of emitted pulsed light beams 11' and reflected light beams 11" is processed. The pulsed light beams 11' are preferably provided independently and unaffected by ambient light as infrared or laser light.

The measurement of the distance and the determination of the respective current speed at defined time intervals enables the determination of the speed curve and, from this, the extent of the braking/deceleration of the rail vehicle and, subsequently, the prediction of the expected stopping point of the rail vehicle. If the determined deceleration of the rail vehicle 4 is recognized as sufficient so that a safe stop of the rail vehicle 4 in front of the buffer stop 2 can take place and a collision of the rail vehicle with the buffer stop therefore does not occur, the correct entry procedure is indicated by means of the optical/acoustic warning device 12, for example as a green light signal. If, however, the determined deceleration of the rail vehicle 4 is recognized as insufficient and a safe stopping of the rail vehicle 4 in front of the buffer stop 2 is determined as not possible and a collision of the rail vehicle with the buffer stop as probable, a warning, for example as a red flashing light signal and siren tone, is emitted to the driver of the rail vehicle 4 as early as possible by means of the optical/acoustic warning device 12. In a preferred embodiment variant, the optical warning signal is output as a flashing signal with a swelling flashing frequency, with the frequency swelling the more the rail vehicle 4 approaches the buffer stop 2 in such a way as to endanger a collision and the greater the predicted probability of a collision occurring. In a further preferred embodiment variant, the acoustic warning signal is coupled in volume and/or frequency to the precalculated potential danger of collision. The entry speed of the rail vehicle 4 into the track end area, the deceleration (braking) curve and the precalculated stopping point are documented with a time stamp in the event of a collision and reported to a control station, which is not shown in more detail, wherein an evaluation of the rail vehicle in form of imagery can also be carried out by the sensor system of the distance measuring device 11 for documentation purposes.

In a particularly preferred embodiment variant, the monitoring device 1 is designed with a vibration measuring device 10. The vibration measuring device 10 detects the impact of the rail vehicle 4 on the buffer stop 2 by means of an acceleration sensor and evaluates the impact event. When the rail vehicle 4 collides with the buffer stop 2, impulse energy is transmitted from the rail vehicle 4 to the buffer stop 2, resulting in an impulsive application of force to the buffer stop 2 from the buffer 4*a* into the impact plate 22, which is registered by the vibration measuring device 10 as an acceleration deflection 10'. If the extent of the collision is moderate, so that the rail vehicle 4 comes to a stop within a distance which is smaller than the sum of the maximum possible elastic/plastic displacement from the buffer 4*a* of the rail vehicle 4 and the displacement path 22" from the impact plate 22 of the buffer stop 2, and the adhesive force with which the buffer stop 2 is fastened to the track system 3 by means of the clamping device 26 is greater than the collision force transmitted to the buffer stop 2 by the rail vehicle 4 during the collision, the impact-like introduction of force causes a damped vibration 10', which is measured and evaluated by the vibration measuring device 10 and reported, documented with a time stamp, to a control station not shown in greater detail. If the extent of the collision is violent/massive, so that the rail vehicle 4 does not come to a standstill within a distance smaller than the sum of the maximum possible elastic/plastic displacement from the buffer 4*a* of the rail vehicle 4 and the displacement path 22" from the impact plate 22 of the buffer stop 2, and the adhesive force with which the buffer 2 is fastened to the track system 3 by means of the clamping device 26 is smaller than the collision force transmitted to the buffer 2 from the rail vehicle 4 during the collision, the impact-like introduction of force causes a displacement 21" of the buffer 2 relative to the track system 3, wherein the extent of the displacement 21" is determined from the vibration curve. The abrupt application of force causes a vibration curve 10" from the superimposition of a damped vibration 10', on which is superimposed a linear displacement of the buffer stop 2 with decreasing speed, which is measured, evaluated and reported by the vibration measuring device 10, documented with a time stamp, to a control station not shown in greater detail. The extent of the linear displacement 21" of the buffer stop 2 is determined approximately from the acceleration curve 10". From the discrete time integral of the acceleration curve 10" results the velocity curve 10" and from the discrete time integral of the velocity curve 10''' results the time curve of the displacement movement 10''''. The accuracy of the displacement path 10'''' determined in this way is influenced by the superimposed damped vibration 10' and can be increased by correction for those vibration components 10' which occur after the first zero crossing of the damped vibration. In this way, an approximate determination of the displacement movement 21" of the buffer stop 2 as a result of a collision is possible with sufficient accuracy, without the need for an additional, complex measuring system.

The monitoring device 1 may have a self-sufficient power supply or be connected to another available power supply and may be connected to a control station by means of a communication device, either wirelessly or wired.

LIST OF REFERENCE SIGNS

- 1 Monitoring device
- 2 Buffer stop, buffer stop system, buffer stop with monitoring device
- 3 Track system, rail
- 4 Rail vehicle
  - 4' Direction of movement and current speed of the rail vehicle
  - 4" Distance of the buffer of the rail vehicle to the buffer of the buffer stop
  - 4*a* Buffer of the rail vehicle
- 10 Vibration measuring device
  - 10' Idealized vibration curve (acceleration a [m/s$^2$]) of buffer stop 2 with free damped vibration (after moderate collision)
  - 10" Idealized vibration curve (acceleration a [m/s$^2$]) of buffer stop 2 in case of violent collision with linear displacement of buffer stop
  - 10''' Velocity curve (v [m/s]) of the displacement of the buffer stop in case of violent collision
  - 10'''' Calculated time curve of the displacement path (s [m]) of the buffer stop in the event of a violent collision
  - 10*a* Discrete velocities (v [m/s]) of the displacement of the buffer stop during violent collision from discrete time integrals of the acceleration curve
  - 10*b* Discrete displacement paths (s [m]) from discrete time integrals of the velocity curve of the displacement of the buffer stop during violent collision
  - 10*c* Discrete fictitious displacement paths 10*c* as a result of the springback of the buffer stop during violent collision
- 11 Distance measuring device
  - 11' Emitted pulsed light beam of the distance measuring device
  - 11" Reflected pulsed light beam of the distance measuring device
- 12 Optical/acoustic warning device
- 20 Normal position of the buffer stop on the track system.
- 21 Buffer stop frame
  - 21' Displacement direction of the buffer stop in case of overload due to violent collision of the rail vehicle with the buffer stop

21" Displacement/displacement path of the buffer stop due to collision relative to the normal position

22 Impact plate of the buffer stop

22' Buffer to buffer frame distance

22" Displacement path/suspension travel of the buffer of the buffer stop

23 Buffer of the buffer stop

24 Transverse head of the buffer stop

25 Optionally, additional spring damping element of the buffer stop

26 Clamping device for friction-locked connection of the buffer stop to the track system

100*a* First acceleration sensor

100*b* Further acceleration sensor.

The invention claimed is:

1. A monitoring device for a buffer stop on a track system, the monitoring device comprising:

at least one acceleration sensor configured and arranged to detect an acceleration of the monitoring device, and;

a vibration measuring device is configured and arranged to calculate a displacement path of the buffer stop from the signals detected by the acceleration sensor.

2. The monitoring device according to claim 1, wherein the vibration measuring device is configured and arranged to integrate the signal of the acceleration sensor twice.

3. The monitoring device of claim 1, wherein the at least one acceleration sensor includes a second acceleration sensor.

4. The monitoring device of claim 1, further including a distance measuring device configured and arranged for determining the distance of an arriving rail vehicle from the buffer stop and for determining the speed profile of the rail vehicle.

5. The monitoring device of claim 1, further including a camera configured and arranged for recording collision events.

6. The monitoring device of claim 1, further including a recording device configured and arranged for storing the signals detected by the acceleration sensor.

7. The monitoring device of claim 1, further including a transmission device configured and arranged for transmitting the signals detected data by the acceleration sensor to a control station.

8. The buffer stop comprising:

a frame, at least one impact plate attached to the frame, the at least one impact plate having an anchoring device, and a monitoring device according to claim 1 is attached to the buffer stop.

9. The buffer stop according to claim 8, wherein the monitoring device is arranged at least partially on the frame of the buffer stop.

10. The buffer stop according to claim 9, wherein the at least one acceleration sensor includes a second acceleration sensor mounted on the buffer stop.

11. A method for monitoring a buffer stop including the following steps:

detecting and evaluating a signal of an acceleration sensor, and a monitoring device according to claim 1 is at least partially attached to the buffer stop and operated.

12. The method according to claim 11, wherein the signal of the acceleration sensor is integrated twice.

13. The method according to claim 12, wherein the integration of the acceleration sensor signal begins when the signal from the acceleration sensor exceeds a first threshold value and ends when the signal from the acceleration sensor falls below a second threshold value for a predetermined period of time.

14. The method according to claim 11, further including the step of detecting a signal of a second acceleration.

15. The method according to claim 11, further including the steps of determining distance of an arriving rail vehicle from the buffer stop and a velocity curve of the arriving rail vehicle.

16. The monitoring device of claim 2, wherein the integration of the acceleration sensor signal starts when the signal of the acceleration sensor exceeds a first threshold value and ends when the signal of the acceleration sensor falls below a second threshold value for a predetermined period of time.

17. The monitoring device of claim 5, wherein the camera is coupled to the acceleration sensor.

* * * * *